US009099823B2

(12) United States Patent
Lai

(10) Patent No.: US 9,099,823 B2
(45) Date of Patent: Aug. 4, 2015

(54) BUFFERING DEVICE FOR FIXING FLEXIBLE CABLE

(71) Applicant: HON HAI PRECISION INDUSTRY CO., LTD., New Taipei (TW)

(72) Inventor: Cheng-Yi Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 33 days.

(21) Appl. No.: 14/140,626

(22) Filed: Dec. 26, 2013

(65) Prior Publication Data

US 2014/0187061 A1 Jul. 3, 2014

(30) Foreign Application Priority Data

Dec. 28, 2012 (TW) ..... 101151001 A

(51) Int. Cl.

| | |
|---|---|
| ***H01R 13/52*** | (2006.01) |
| ***H01R 12/81*** | (2011.01) |
| ***H01R 12/91*** | (2011.01) |
| *H01R 13/58* | (2006.01) |

(52) U.S. Cl.

CPC ..... *H01R 12/81* (2013.01); *H01R 12/91* (2013.01); *H01R 13/5825* (2013.01)

(58) Field of Classification Search

CPC .... H01R 12/71; H01R 12/81; H01R 13/5825; H01R 12/91; H01R 12/62; H01R 13/6594; H01R 9/091

USPC ..... 439/67

See application file for complete search history.

(56) References Cited

U.S. PATENT DOCUMENTS

| | | | | |
|---|---|---|---|---|
| 5,038,622 | A * | 8/1991 | Tijmann | 73/862.393 |
| 7,497,715 | B2 * | 3/2009 | Wu | 439/329 |
| 8,783,115 | B2 * | 7/2014 | Chen | 73/818 |
| 8,840,415 | B2 * | 9/2014 | Orris et al. | 439/329 |
| 8,913,388 | B2 * | 12/2014 | Teo et al. | 361/704 |
| 8,939,794 | B2 * | 1/2015 | Mason et al. | 439/581 |
| 2002/0059834 | A1 | 5/2002 | Onoue | |
| 2009/0311887 | A1 * | 12/2009 | Zhu | 439/67 |
| 2012/0286904 | A1 * | 11/2012 | Ikeuchi et al. | 333/260 |

FOREIGN PATENT DOCUMENTS

| | | |
|---|---|---|
| TW | 201203721 A1 | 1/2012 |
| TW | M440035 U1 | 11/2012 |

* cited by examiner

*Primary Examiner* — Jean F Duverne

(74) *Attorney, Agent, or Firm* — Novak Druce Connolly Bove + Quigg LLP

(57) ABSTRACT

A buffering device for fixing a flexible cable includes a fixing part and a moving part. The two connecting ends of the flexible cable move relatively to each other. One of the connecting ends is connected to a circuit board. The fixing part defines two sliding cutouts fixed at two opposite sides of the flexible cable and adjacent to the connecting end of the flexible cable clamping and sandwich the flexible cable between the mount and the circuit board. The moving part includes a movable support and two second cushions. The movable support comprises a top support frame and a bottom support frame. The movable support is inserted into the sliding cutouts and moves back and forth in the sliding cutouts. The two second cushions sandwich the flexible cable between the top support frame and a bottom support frame.

9 Claims, 7 Drawing Sheets

BUFFERING DEVICE FOR FIXING FLEXIBLE CABLE

BACKGROUND

1. Technical Field

The disclosure generally relates to circuit connecting technologies, and more particularly, to a buffering device for fixing a flexible cable.

2. Description of Related Art

Generally, a flexible cable, such as a flexible circuit board, is used to connect two separate circuit boards. The two circuit boards connected to the flexible circuit board are often movable relatively to each other, thus the joints of the connecting ends of the flexible circuit board and the circuit boards are easily damaged.

Therefore, it is desirable to provide a means which can overcome the above-mentioned problems.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

Figure 1:
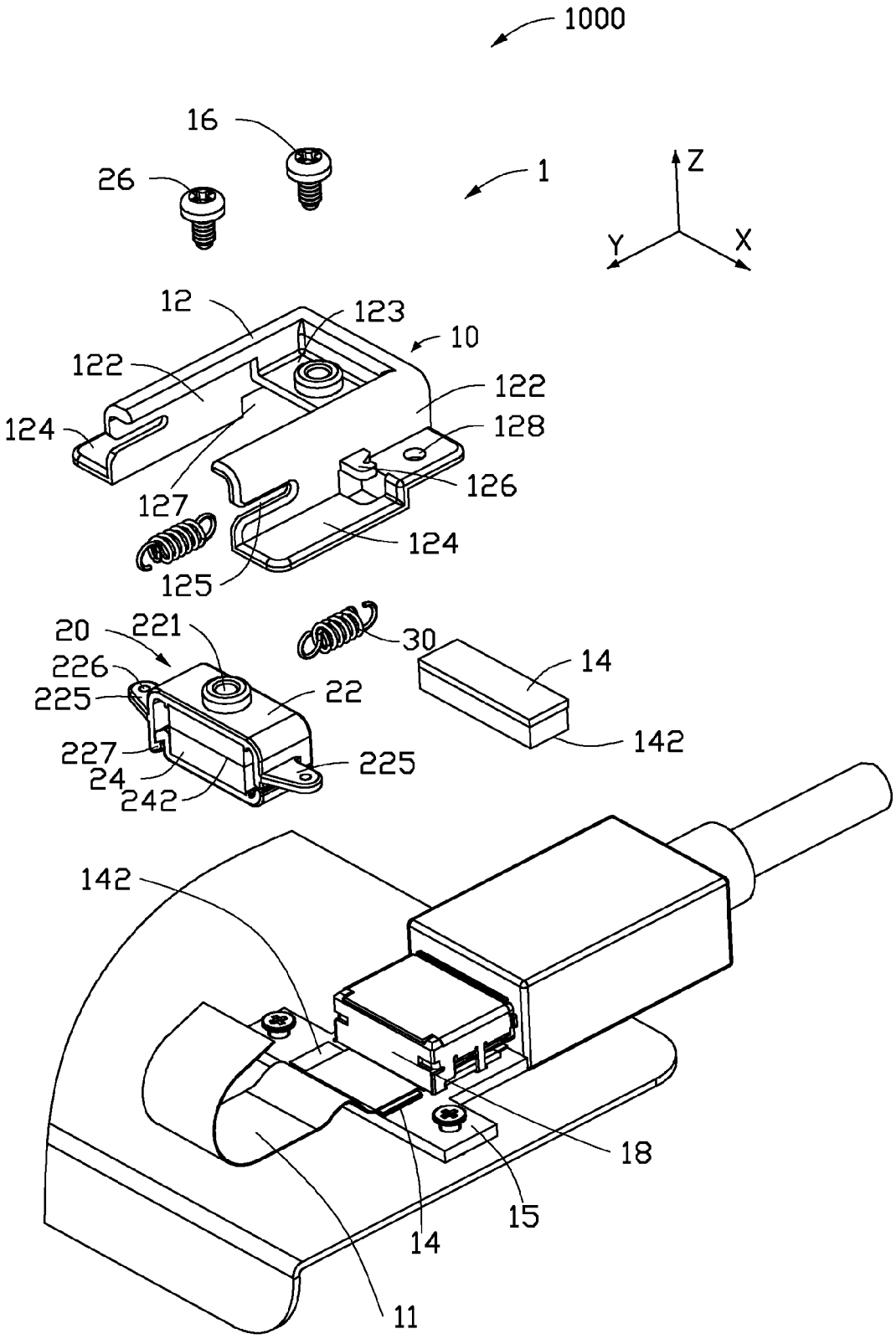
FIG. 1 is an exploded, isometric view of an exemplary embodiment of a buffering device, the buffering device including a mount and a movable support.

FIG. 1 shows an exemplary embodiment of an electronic device 1000. The electronic device 1000 includes a circuit board 15, a flexible cable 11 connected to the circuit board 15, and a buffering device 1 connecting the flexible cable 11 with the circuit board 15. In the illustrated embodiment, the flexible cable 11 is a flexible circuit board (FPC) 11. The two connecting ends of the flexible circuit board are movable relative to each other. One of the two connecting ends of the flexible circuit board 11 is soldered on a connector 18 of a circuit board 15.

The buffering device 1 includes a fixing part 10, a moving part 20 and two springs 30 connecting the moving part 20 with the fixing part 10. The fixing part 10 includes a mount 12, two first cushions 14 and a first adjustment screw 16. The moving part 20 includes a movable support 22, two second cushions 24, and a second adjustment screw 26.

Figure 2:
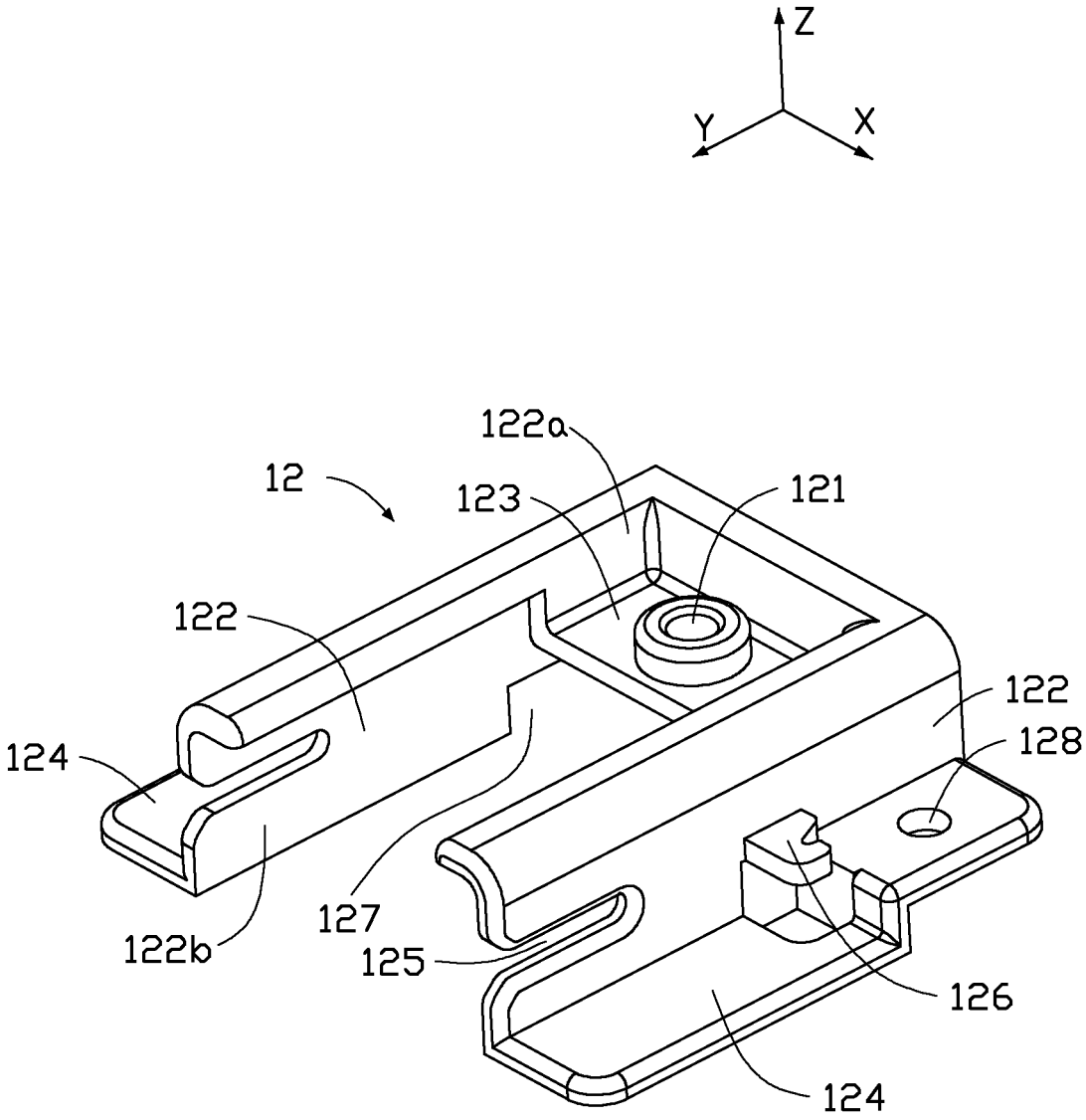
FIG. 2 is an enlarged view of the mount of FIG. 1.

FIG. 2 shows an enlarged view of the mount 12. The mount 12 includes a pair of sidewalls 122, a bridge 123, and two flanges 124. The sidewalls 122 are substantially parallel to each other and extended along a first direction (Y axis). Each of the sidewalls 122 includes a first end 122*a* and a second end 122*b* opposite to the first end 122*a* in the first direction. The bridge 123 connects the pair of the sidewalls 122 at the first ends 122*a* and extends along a second direction (X axis) perpendicular to the first direction. A first threaded through hole 121 is defined in the bridge 123. The flanges 124 are correspondingly extended from a bottom side of each sidewall 122 along two opposite directions perpendicular to the sidewalls 122. Each of the two sidewalls 122 defines a sliding cutout 125 at the second end 122*b* and a notch 127 at the first end 122*a*. Each of the sliding cutouts 125 is away from the bridge 123 and extended along the first direction. Each of the notches 127 is defined in the bottom side of a sidewall 122 below the bridge 123, and thus each flange 124 is shaped as a step. Two through holes 128 are defined in an upper portion of the flanges 124 respectively. Each of the sidewalls 122 includes a hook 126 formed on an outer surface of the sidewalls 126.

In the illustrated embodiment, the first cushions 14 are foam. The two first cushions 14 are located opposite to each other. The opposite surfaces of the first cushions 14 are defined as first keep surfaces 142.

Figure 3:
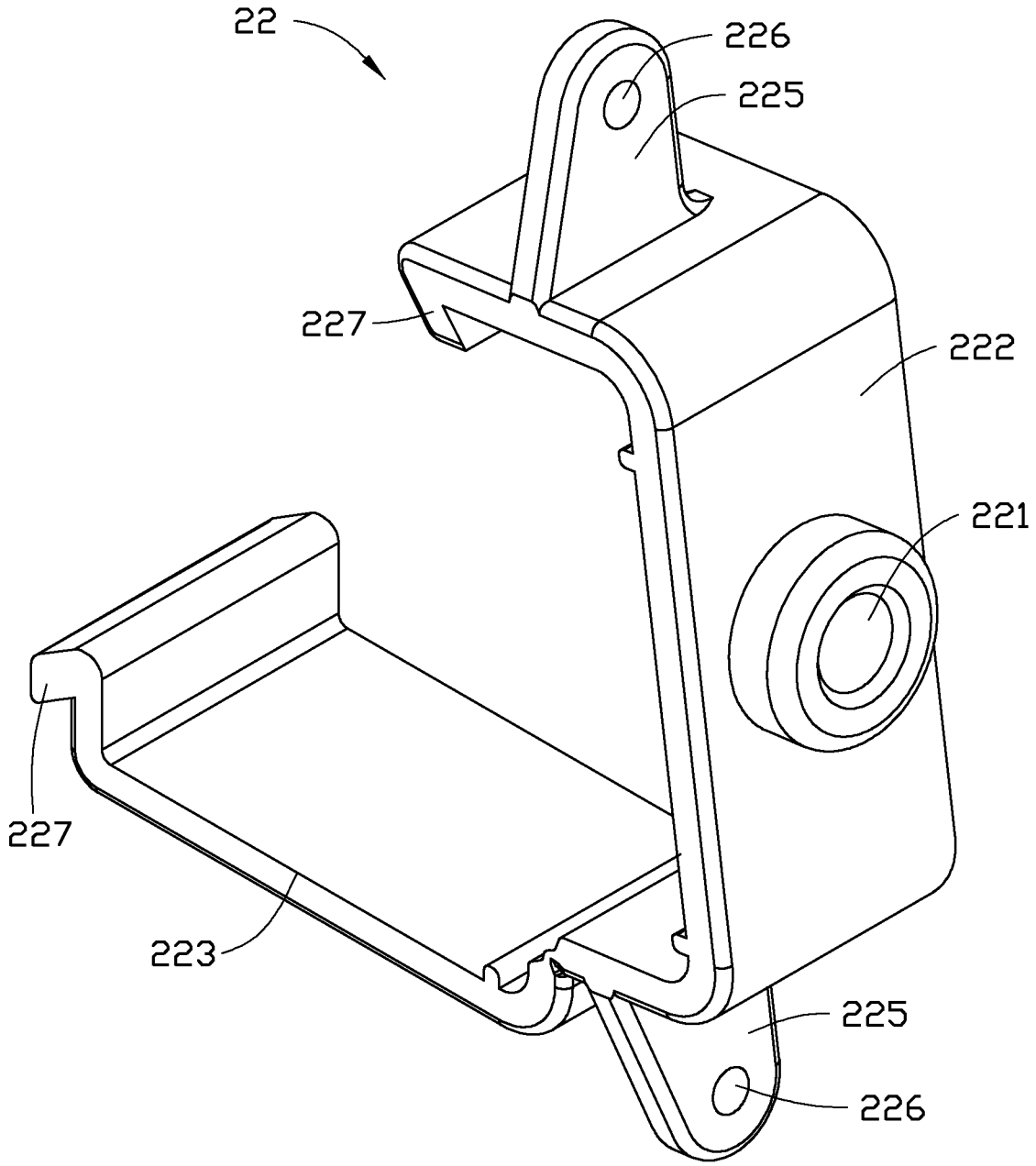
FIG. 3 is an enlarged view of the movable support of FIG. 1.

FIG. 3 shows an enlarged view of the movable support 22. The movable support 22 includes a top support frame 222 and a bottom support frame 223. The top support frame 222 and the bottom support frame 223 are rotatably connected to each other. The top support frame 222 includes a locking structure 227, and a pair of fixing plants 225 protruding from opposite sides of the top support frame 222. A second threaded through hole 221 is defined in the top surface of the top support frame 222. Two fixing holes 226 are defined in the pair of fixing plants 225 respectively. The bottom support frame 223 includes a locking structure 227. One of the two ends of the top support frame 222 is rotatably connected to one of the two ends of the bottom support frame 223. The locking structures 227 of the top support frame 222 and the bottom support frame 223 are located on the other one of the two ends of the top support frame 222 and the bottom support frame 223, respectively.

The movable support 22 can be switched between an open-status and a closed-status. When the movable support 22 is in an open-status, the locking structure 227 of the top support frame 222 and the locking structure 227 of the bottom support frame 223 are apart from each other, and the top support frame 222 is capable of rotating around the bottom support frame 223. When the movable support 22 is in a closed-status, the locking structure 227 of the top support frame 222 fastens the locking structure 227 of the bottom support frame 223. In the illustrated embodiment, the locking structures 227 are hooks.

In the illustrated embodiment, the second cushions 24 are foam. The two second cushions 24 are located opposite to each other. The opposite surfaces of the second cushions 24 are defined as second keep surfaces 242.

Figure 4:
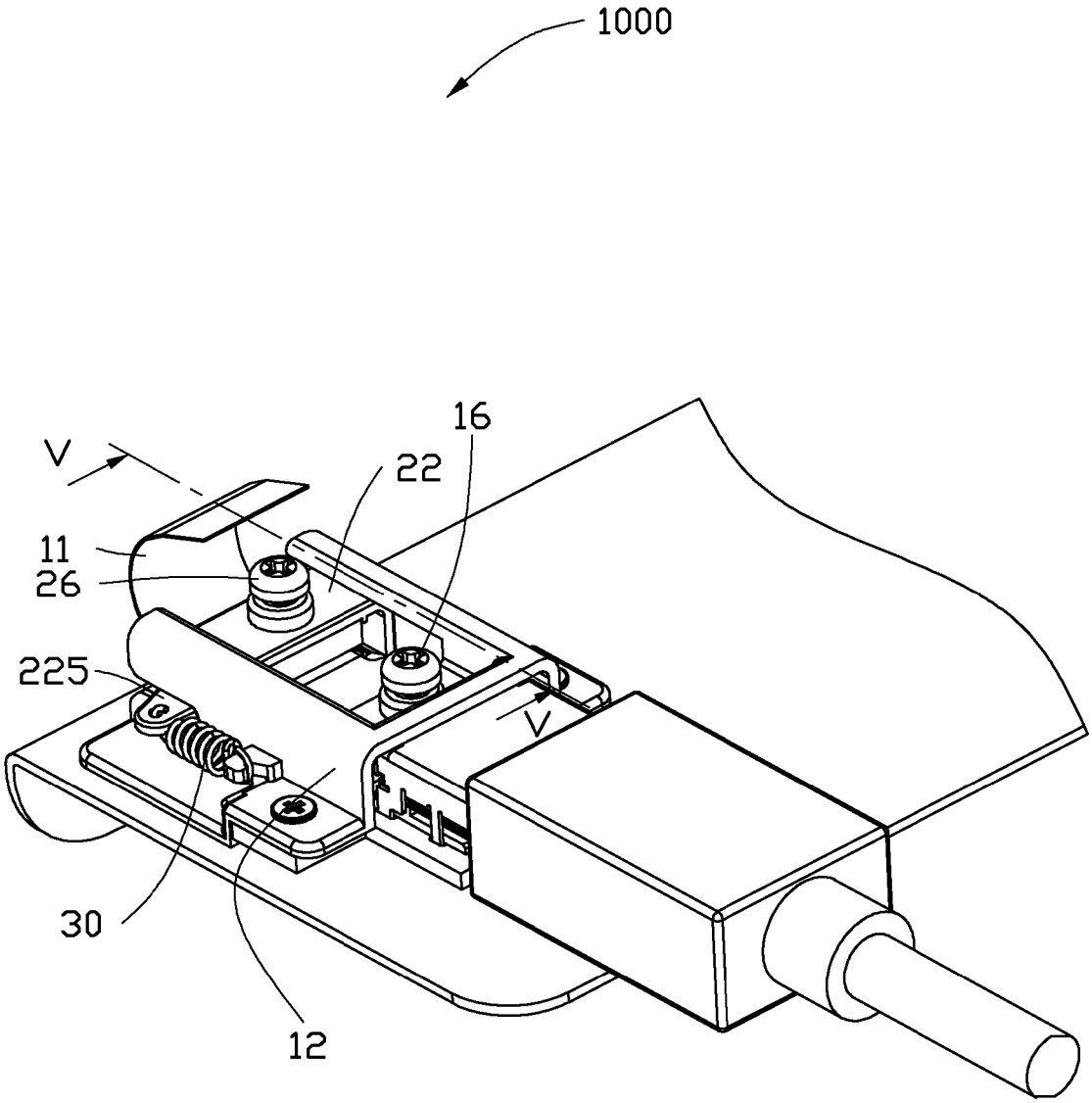
FIG. 4 is an assembled, isometric view of the buffering device of FIG. 1, the movable support is in an initial position.
Figure 5:
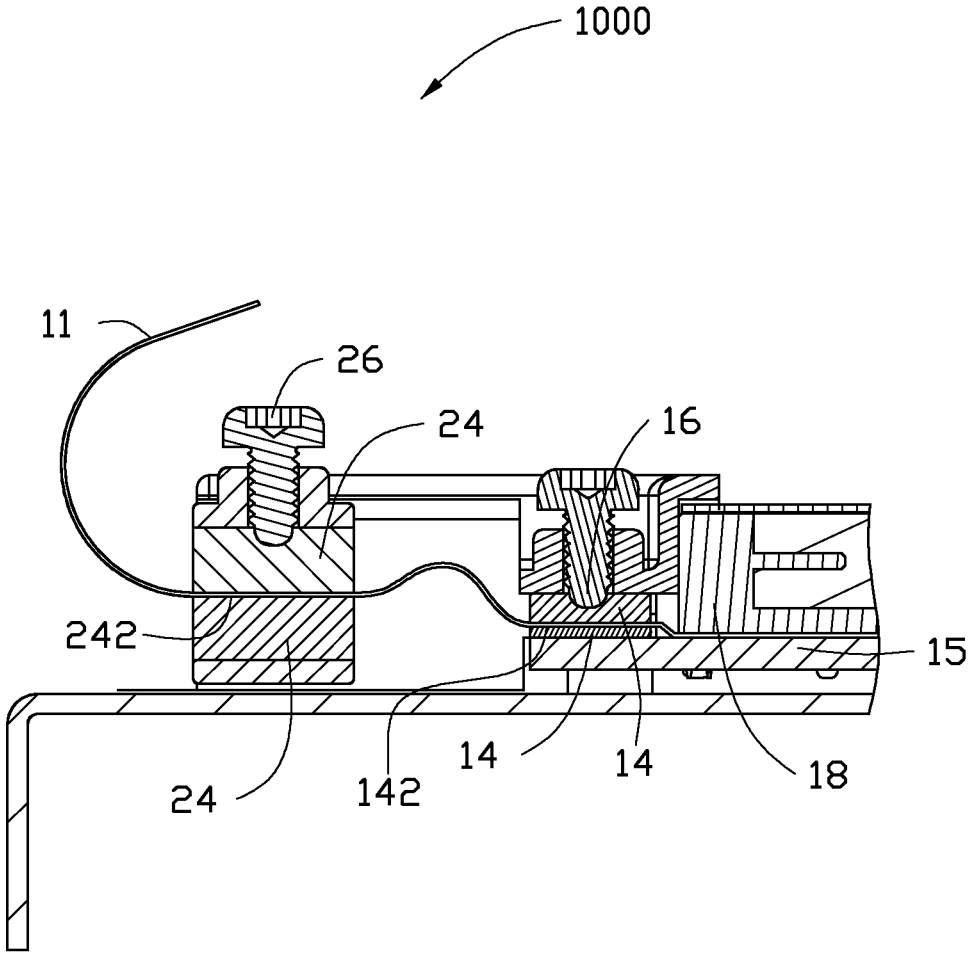
FIG. 5 is a cross-sectional view of the buffering device taken along line V-V of FIG. 4.

FIG. 4 and FIG. 5 show that the buffering device 1 is assembled in an electrical device 1000 for fixing the flexible circuit board 11 with the circuit board 15. One of the two connecting ends of the flexible circuit board 11 is soldered on a connector 18 of the circuit board 15. The two connecting ends of the flexible circuit board are movable relatively to each other. The notches 127 of the mount 12 are set above the circuit board 15. The upper portions of the flanges 124 are located above the circuit board 15, and the lower portions of the flanges 124 are located above the shell of the electrical device 1000. The mount 12 is fixed on the electrical device 1000 by two screws through the through holes 128 and the circuit board 15.

The two first cushions 14 are fixed at two opposite sides of the flexible circuit board 11 respectively adjacent to the connecting end of the flexible circuit board 11, and the two first cushion surfaces 142 of the two first cushions 42 clamp the flexible circuit board 11. The two first cushions are sandwiched between the bridge 123 and the circuit board 15. The flexible circuit board 11 is sandwiched between the two first cushions 14. One of the two first cushions 14 is located between the circuit board 15 and the flexible circuit board 11, and the other one of the two first cushions 14 is located between the flexible circuit board 11 and the bridge 123.

The first adjustment screw 16 is screwed in the first threaded through hole 121 of the bridge 123 and against the first cushion 14 located between the flexible circuit board 11 and the bridge 123. The friction between the two first cushions 14 and the flexible circuit board 11 is adjusted by depth of the first adjustment screw 16 being screwed in.

When the buffering device 1 is assembled, the movable support 22 is in the close-status. The locking structure 227 of the top support frame 222 fastens the locking structure 227 of the bottom support frame 223. The two second cushions 24 are sandwiched between the top support frame 222 and the bottom support frame 223. The flexible circuit board 11 is sandwiched between the two second cushions 24, and the two second cushion surfaces 242 of the two second cushions 24 clamp the flexible circuit board 11. One of the two second cushions 24 is located between the inner surface of the top support frame 222 and flexible circuit board 11, and the other one of the two second cushions 24 is located between the flexible circuit board 11 and the inner surface of the bottom support frame 223.

The second adjustment screw 26 is screwed in the second threaded through hole 221 of the top support frame 222 and against the second cushion 24 located between the flexible circuit board 11 and the top support frame 222. Friction between the two second cushions 24 and the flexible circuit board 11 is adjusted by depth of the second adjustment screw 26 being screwed in.

The two fixing plants 225 of the movable support 22 are inserted into the two sliding cutouts 125 of the mount 12 respectively and configured to move back and forth in the sliding cutouts 125. One of the two ends of each spring 30 is fixed on a hook 126 of the mount 12, and the other one of the two ends of each spring 30 is fixed on the fixing hole 226 of the fixing plant 225. The springs 30 pull the fixing plants 225 in the direction of the hooks 126 until the fixing plants 225 touch the ends of the sliding cutouts 125, and the movable support 22 is fixed on the mount 12 in an initial position. A length of the flexible circuit board 11 between the movable support 22 and the mount 12 is longer than a distance between the movable support 22 and the mount 12, to allow the flexible circuit board 11 between the movable support 22 and the mount 12 to be squeezed to an arch structure.

When the two connecting ends of the flexible circuit board 11 are in a relatively static state, there is no relatively displacement between the buffering device 1 and the flexible circuit board 11, and the movable support 22 is in the initial position.

Figure 6:
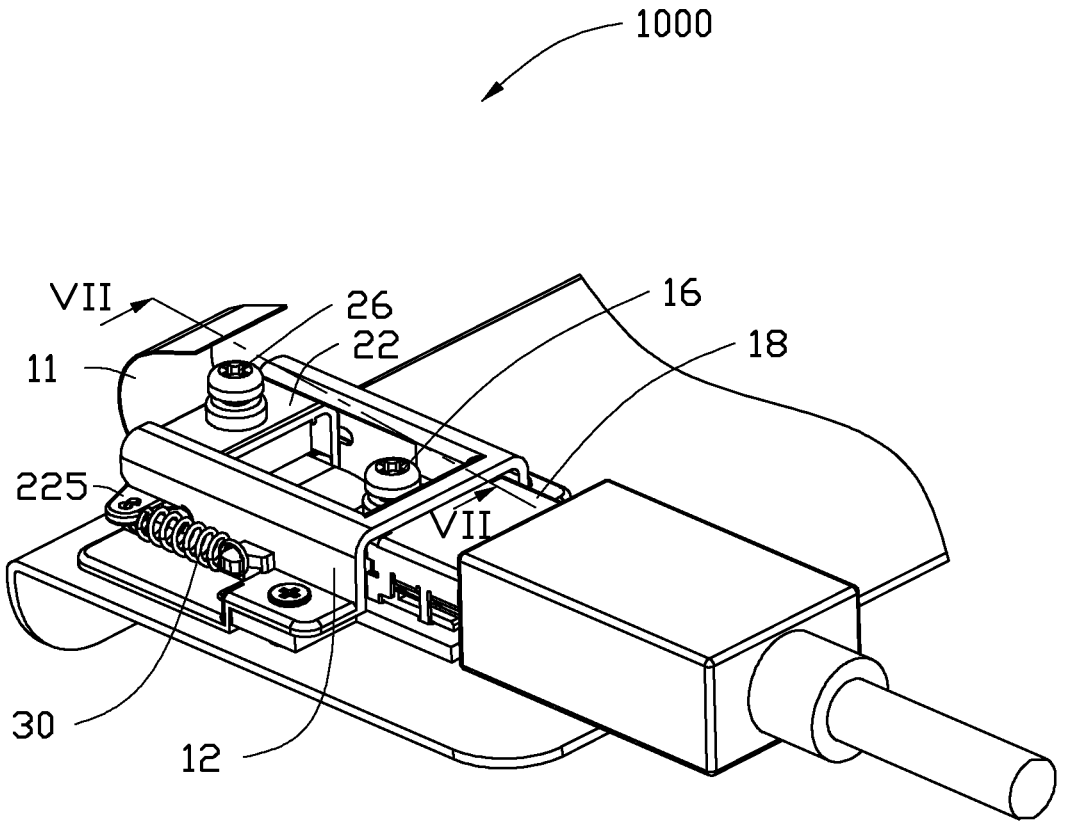
FIG. 6 is an assembled, isometric view of the buffering device of FIG. 1, the movable support is pulled away from the initial position.
Figure 7:
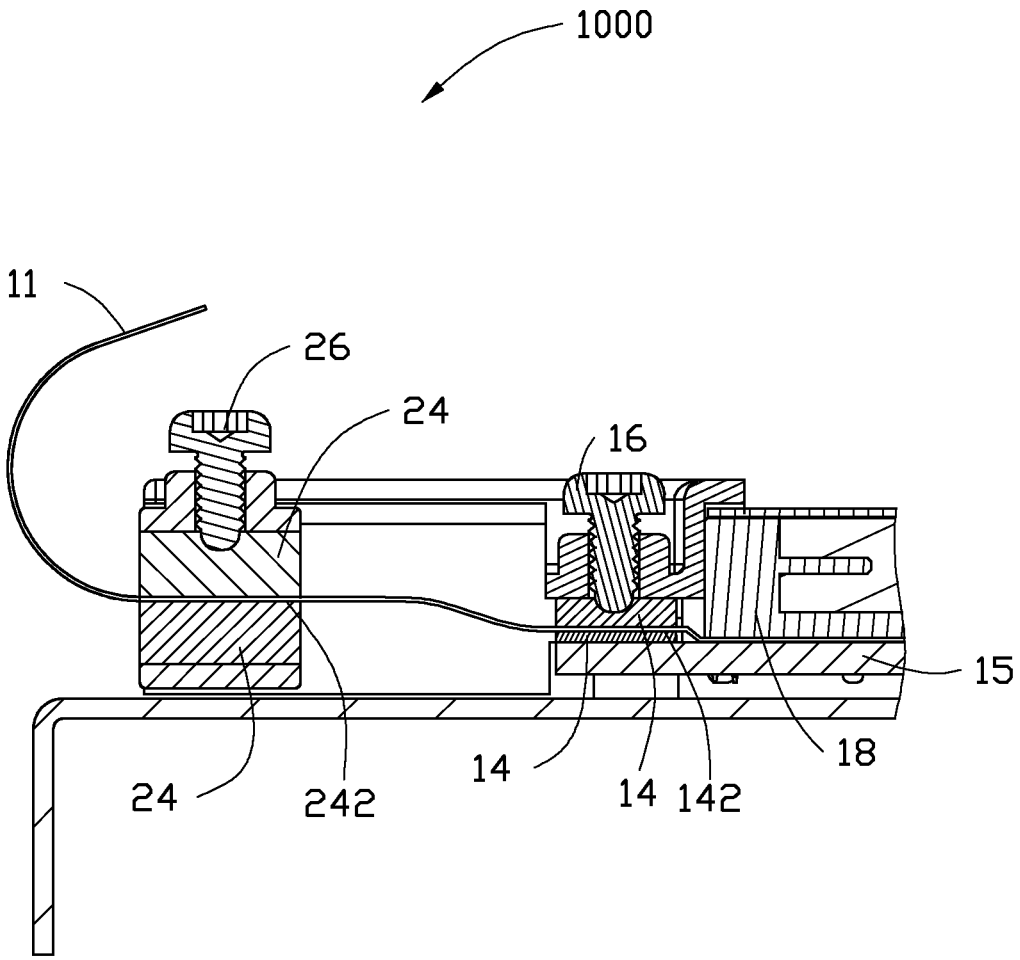
FIG. 7 is a cross-sectional view of the buffering device taken along line VII-VII of FIG. 6.

FIG. 6 and FIG. 7 show that when the two connecting ends of the flexible circuit board 11 are in a movable state, the flexible circuit board 11 is pulled and a pulling force is generated.

If the pulling force is less than the elastic force of the springs 30, the movable support 22 stays at the initial position. The two first cushions 14 and the two second cushions 24 clamp the flexible circuit board 11 to fix the flexible circuit board 11, and there is no relatively displacement between the connecting end of the flexible circuit board 11 adjacent to the connector 18 and the connector 18. The connecting end of the flexible circuit board 11 adjacent to the connector 18 of the circuit board 15 is not easily adversely affected.

If the pulling force is greater than the elastic force of the springs 30, the pulling force pulls the movable support 22 in the direction away from the mount 12. The length and the elastic force of the springs 30 and the distance between the mount 12 and the movable support 22 are increased until the elastic force is equal to the pulling force. The arch structure of the flexible circuit board 11 between the mount 12 and the movable support 22 buffers the increase of the distance between the mount 12 and the movable support 22 to protect the connecting end of the flexible circuit board 11 adjacent to the connector 18. The two first cushions 14 and the two second cushions 24 clamp the flexible circuit board 11 to fix the flexible circuit board 11. In addition, there is no relatively displacement between the connecting end of the flexible circuit board 11 adjacent to the connector 18 and the connector 18, and the connecting end of the flexible circuit board 11 adjacent to the connector 18 of the circuit board 15 is not easily affected.

The buffering device 1 counteracts the pulling force by the elastic force of the springs 30. In addition, the first cushions 14 and the second cushions 24 clamp the flexible circuit board 11 to protect the joint of the connecting end of the flexible circuit board 11 and the circuit board 15 when the flexible circuit board 11 is pulled by the circuit boards. The buffering device 1 has simple structure, and is low cost and easy to be manufactured and assembled.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A buffering device for fixing a flexible cable, the two connecting ends of the flexible cable are movable relative to each other, at least one of the connecting ends of the flexible cable is connected to a circuit board, the buffering device comprising:

a fixing part comprising a mount and two first cushions, the mount defines at least one sliding cutout, the two first cushions are fixed at two opposite sides of the flexible cable and adjacent to the connecting end of the flexible cable to clamp the flexible cable, and sandwiched between the mount and the circuit board; and a moving part comprising a movable support and two second cushions, the movable support comprises a top support frame and a bottom support frame, the movable support is inserted into the sliding cutout and configured to move back and forth in the sliding cutout, the two second cushions are fixed at two opposite sides of the flexible cable to clamp the flexible cable, and sandwiched between the top support frame and a bottom support frame.

2. The buffering device of claim 1, wherein a length of the flexible cable between the movable support and the mount is longer than a distance between the movable support and the mount.

3. The buffering device of claim 2, wherein the buffering device further comprises at least one spring, the spring supplies elastic force while the movable support moves back and forth in the sliding cutout.

4. The buffering device of claim 3, wherein the mount further comprises a bridge and a pair of sidewalls, the pair of sidewalls are substantially parallel to each other and extended along a first direction, each of the two sidewalls includes a first end and a second end opposite to the first end in the first direction, the bridge connects the pair of the sidewalls at the first ends and extends along a second direction perpendicular to the first direction, each of the two sidewalls defines the sliding cutouts at the second end, the top support frame comprises a pair of fixing plants protruding from opposite sides of the top support frame, the two fixing plants are inserted into the sliding cutouts and configured to move back and forth in the sliding cutout.

5. The buffering device of claim 4, wherein a first threaded through hole is defined in the bridge, a first adjustment screw is screwed in the first threaded through hole and against one of the first cushions, the friction between the two first cushions and the flexible cable is adjusted by depth of the first adjustment screw being screwed in.

6. The buffering device of claim 5, wherein one of the two ends of the top support frame is rotatably connected to one of the two ends of the bottom support frame, each of the other one of the two ends of the top support frame and the bottom support frame includes a locking structure, the movable support can be switched between an open-status and a close-status, when the movable support is in an open-status, the locking structure of the top support frame and the locking structure of the bottom support frame are apart from each other, and the top support frame is capable of rotating around the bottom support frame, when the movable support is in a close-status, the locking structure of the top support frame fastens the locking structure of the bottom support frame.

7. The buffering device of claim 6, wherein one of the two second cushions is located between the inner surface of the top support frame and the flexible cable, the other one of the two second cushions is located between the flexible cable and the inner surface of the bottom support frame, a second threaded through hole is defined in the top surface of the top support frame, a second adjustment screw is screwed in the second threaded through hole and against one of the second cushions, the friction between the two second cushions and the flexible cable is adjusted by depth of the second adjustment screw being screwed in.

8. The buffering device of claim 7, wherein each of the sidewalls includes a hook formed on an outer surface of the sidewalls, one of the two ends of each spring is fixed on a hook, and the other one of the two ends of each spring is fixed on the fixing plant.

9. The buffering device of claim 8, wherein when the buffering device is assembled, the movable support is in a close-status, the springs pull the fixing plants in the direction of the hooks until the fixing plants touch the ends of the sliding cutouts, the movable support is fixed on the mount in an initial position, and flexible cable between the movable support and the mount is squeezed to an arch structure.

* * * * *